US006873283B2

(12) United States Patent
Zaar

(10) Patent No.: US 6,873,283 B2
(45) Date of Patent: Mar. 29, 2005

(54) REVERSE BALLOON

(75) Inventor: Johan Zaar, Västervik (SE)

(73) Assignee: SAAB Barracuda AB, Gamleby (SE)

( * ) Notice: Subject to any disclaimer, the term of this patent is extended or adjusted under 35 U.S.C. 154(b) by 0 days.

(21) Appl. No.: 10/474,441

(22) PCT Filed: Mar. 28, 2002

(86) PCT No.: PCT/SE02/00628

§ 371 (c)(1),
(2), (4) Date: Oct. 9, 2003

(87) PCT Pub. No.: WO02/084203

PCT Pub. Date: Oct. 24, 2003

(65) Prior Publication Data

US 2004/0108950 A1 Jun. 10, 2004

(30) Foreign Application Priority Data

Apr. 9, 2001 (SE) ..... 0101254-1

(51) Int. Cl.[7] ..... H01Q 17/00
(52) U.S. Cl. ..... 342/3; 342/4; 342/10
(58) Field of Search ..... 342/1, 2, 3, 4, 342/5, 8, 9, 10, 13

(56) References Cited

U.S. PATENT DOCUMENTS 2,702,900 A * 2/1955 Matson, Jr. ..... 342/7
3,279,419 A * 10/1966 DeMarco ..... 116/210
3,604,001 A * 9/1971 Deal ..... 250/338.1
4,170,010 A * 10/1979 Reed ..... 342/1
4,473,826 A * 9/1984 Pusch et al. ..... 342/5
5,094,168 A * 3/1992 Rumer ..... 102/334
5,424,741 A 6/1995 Genovese ..... 342/10
5,739,458 A 4/1998 Girard ..... 89/36.02
5,942,716 A 8/1999 Miller ..... 89/36.17
2004/0108950 A1 * 6/2004 Zaar ..... 342/3

FOREIGN PATENT DOCUMENTS

DE 3312169 10/1984
DE 3312169 A * 10/1984 ..... F41H/3/00

OTHER PUBLICATIONS

"Mobility analysis of the large adaptive reflector antenna reflector", Dalong Wang; Meng, M.; Electrical and Computer Engineering, 2000 Canadian Conference on, vol.: 2, Mar. 7–10, 2000 pp.: 865–869.*

* cited by examiner

*Primary Examiner*—John B. Sotomayor
(74) *Attorney, Agent, or Firm*—Swidler Berlin LLP

(57) ABSTRACT

A rapidly deployable camouflage device for concealing recognizable signatures of military objects, comprising a camouflage balloon (1) and a deployment and undeployment device, the latter being equipped with a housing (2) and a fan (3) for inflating the balloon (1) arranged on an opening (4) in the housing. According to the invention, the balloon can be pulled into the housing by means of pull lines (7) secured at one end to the inside of the balloon opposite the opening (4), and at the other end to a motor-driven winding device inside the housing (2). The balloon is thus pulled in in such a way that it is reversed inside the housing, from which state if can then be blown out unreversed as rapidly deployable camouflage.

8 Claims, 2 Drawing Sheets

REVERSE BALLOON

AREA OF THE INVENTION

The invention concerns camouflage primarily for military applications and, more specifically, devices suited for application to objects such as vehicles, tanks, artillery guns, etc. in order to eliminate, to the greatest possible extent, typical signatures in terms of their appearance that may be perceptible by observation means such as photography in normal light, UV, IR reconnaissance or radar reconnaissance. The invention pertains more specifically to camouflage that can be deployed rapidly and undeployed with equal speed to enable the unobstructed use of the object.

1. Object of the Invention

The most important object of the invention is to provide rapidly deployable and rapidly undeployable camouflage that can be used a plurality of times and occupies little space when not in use. Another object is to provide such camouflage whose light and deployable component can be treated as a consumable material, albeit certainly usable a plurality of times as a rule, and which component can be easily installed in a deployment and undeployment device that can be permanently installed on the object intended to be camouflaged.

2. State of the Art

Camouflage devices comprising different types of deployment and removal or undeployment means are previously known. For example, there are designs that are deployed and undeployed like umbrellas. Inflatable balloon devices are also previously known. For example, U.S. Pat. No. 5,942,716 describes a type of inflatable structure that can be rapidly inflated if a missile-homing laser beam is detected, whereupon the inflated structure functions as a type of reflective object. However, no description of the retrieval of these structures is provided.

SUMMARY OF THE INVENTION

The foregoing objects and other objects and advantages are achieved according to the invention by means of a pneumatic system in which a camouflage balloon can, from a housing of lesser volume, be deployed, inflated and subsequently, when so desired, pulled back into the housing. This is achieved via a rapidly deployable camouflage according to claim 1 or a camouflage balloon according to claim 4 in combination with a deployment and undeployment device according to FIG. 3.

Fundamental to the rapid action achieved according to the invention is that the camouflage balloon, at least a portion of whose outer surface is camouflage-colored and may comprise radar-reflecting, absorbing or partially electrically conductive material, has an opening that can be secured to a deployment and undeployment device, opposite which opening there is secured, on the inside, one end of at least one and preferably two pull cords or lines, whereby the balloon can be pulled back into the deployment and undeployment device and thereby reversed or unreversed. It is thus stored reversed in a compartment inside the deployment and undeployment device when not in use, where it is in principle wound onto a roller. The balloon is normally replaceable and generally to be viewed as consumable material. A fan or the like is normally used to inflate the balloon. However, there is nothing to prevent the balloon from being inflated by some other means, using gas from a gas source. When the balloon is to be replaced into its deployment and undeployment device, it is possible to let the air escape via a clack valve in its housing. However, in cold climates where such a valve is at risk of becoming frozen stuck, it has proved possible to let the air pass back through the fan if it is realized as a centrifugal fan, although this does entail special design measures that will be described.

It is desirable for the balloon to be made of a somewhat air-permeable material, and for the deployment and undeployment device to keep the deployed balloon outwardly stretched by means of an airflow that is weak relative to the inflation airflow, which weak airflow is intended to give the balloon a temperature that is appropriate to its surroundings. In many cases the balloon may be intended to conceal not only otherwise recognizable visual signatures, but also hot spots from, e.g. engines. The fan can also be operated almost silently. It is appropriate to arrange means to control the temperature of the in-blown air via warming or cooling, whereupon the thermal signature can be controlled.

BRIEF DESCRIPTION OF THE FIGURES

The invention will now be described in the form of exemplary embodiments and with reference to the figures.

FIG. 4 presents a side view of a deployment and undeployment device, while

DETAILED DESCRIPTION OF EXEMPLARY EMBODIMENT

Figure 1:
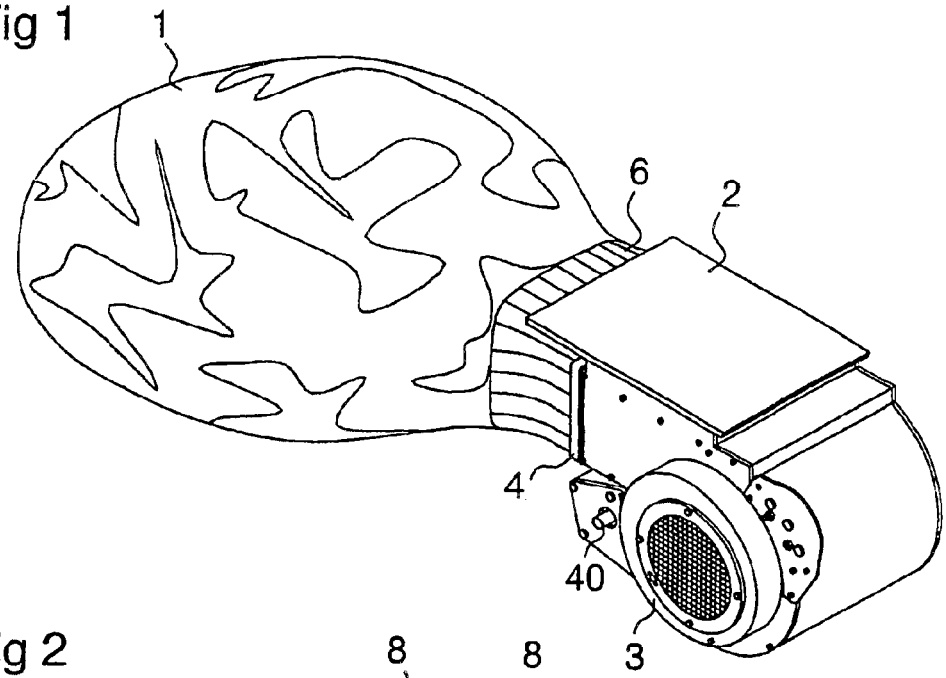
FIG. 1 shows a schematic perspective view of an activated camouflage device together with its deployment and undeployment device.

FIG. 1 provides a highly schematic perspective view of a camouflage balloon that is being kept inflated by a deployment and undeployment device 2. The device is equipped with a semi-cylindrical housing having an external fan 3 of the centrifugal type—the motor sits within. An inflation opening for the balloon is threaded and secured onto a neck 4 with a flange. The balloon is provided with a camouflage pattern that can vary depending on the environment in which it is used, the time of year, etc. It may comprise conductive wires or other electrically conductive material for the purpose of achieving radar camouflage, or other colors, coatings, etc. in order to achieve, in a manner that is known per se, a camouflaging effect in visible light, within the IR and/or UV ranges, or vis-a-vis radar reconnaissance.

Figure 2:
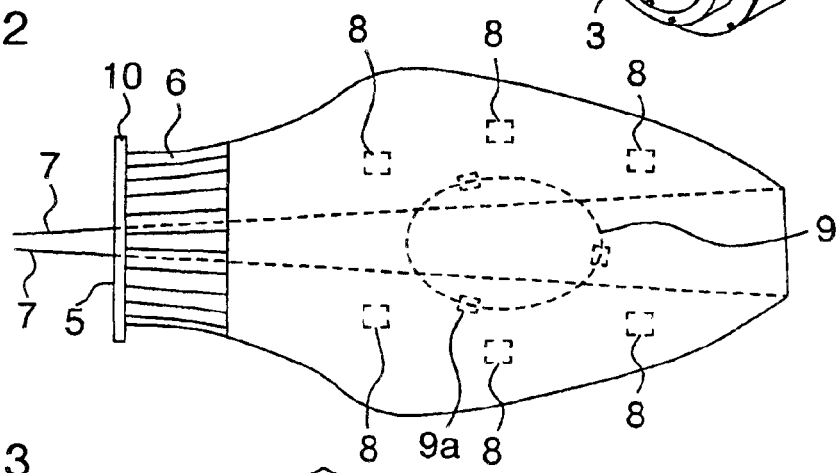
FIG. 2 show a diagram of a deployed camouflage balloon.

FIG. 2 depicts a similar camouflage balloon laid out flat on a plane, where it can be seen that the inflation opening 5 has an adjacent reinforcement 6, while the rest of the balloon consists of a lighter material such as a fabric, a non-woven fabric or the like, which need not be entirely impervious to air. The polyamide fabric used in the lightest types of spinnakers (gram weight e.g. 32 grams/$m^2$ before the application of camouflage coating) has proven to be a suitable product. The figure further shows that two pull lines 7 are run inside the balloon, each of which has one of its ends secured to the inside and opposite the opening 5, while their other ends are threaded out through the opening 5. In the preferred embodiment these lines comprise sections of a single line, whose middle section is sewn securely to the balloon opposite the opening. (The depicted middle section is straight only when the balloon is laid out flat, and will naturally become curved upon inflation). As will become evident, these lines are used to pull the balloon into the housing 2 (FIG. 1) in that the lines are pulled in by means of a winding device, which will be described below. The air volume inside the balloon will then be forced into the box 2 before then escaping either back through the fan or via a clack valve. Once the balloon has thus been pulled in, it is obvious that it will be reversed, so that the outside of the balloon will now face inward. Deployment occurs in the reverse order, in that the winding device feeds the line out and/or is free-spinning, while the balloon is pushed out by the air pressure generated by the fan. The figure also shows how the lines are pulled in separated by a common spacing that narrows as it approaches the winding device, a feature that has been found to facilitate stable conditions for pulling in the balloon.

FIG. 2 also shows that special extended limiting devices 8 are secured, on the inside, to each their own counterposed cloth surfaces. During inflation these devices locally limit the common spacing between the lines and thus impart a somewhat irregular shape to the balloon. On the underside there is, represented by broken lines, a weight such as a lead-weighted string 9, which may be supplemented with small magnets 9*a*, and which in either case makes it easier to maintain the stable positioning of the balloon on, e.g. a tank.

The inflation opening 5 is equipped with an appropriately designed strap to secure it to a housing.

When the balloon is pulled in, the reinforcement at the ventilation opening forms a sort of funnel, in that the balloon is drained of its internal air, which air is forced out backward through the then-undriven fan (or via e.g. a clack valve).

Figure 3:
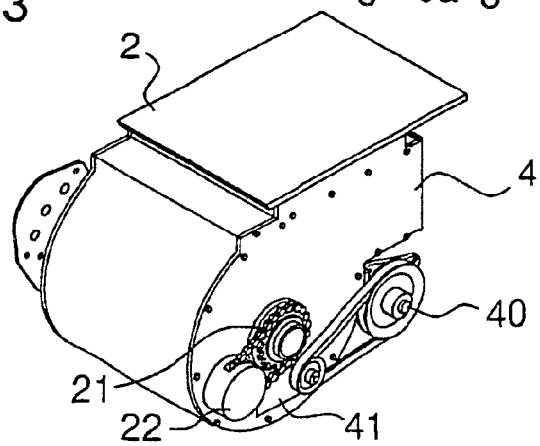
FIG. 3 shows a highly schematic view of the opposite side of the deployment and undeployment device shown in FIG. 1.
Figure 4:
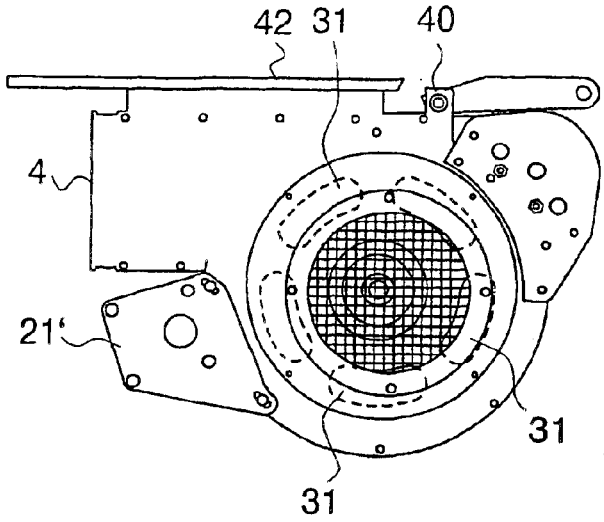
Figure 5:
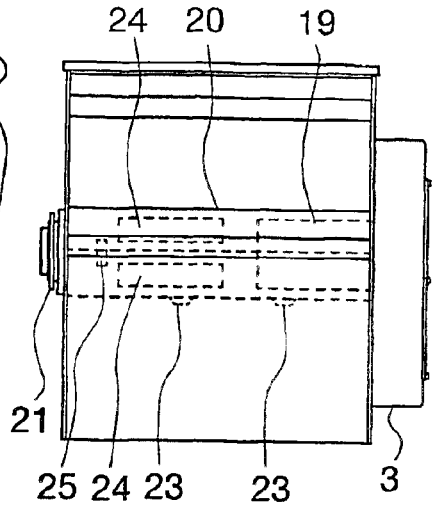
FIG. 5 provides a cross-section view through the same device.

In the embodiment depicted in FIG. 4, which is shown in a cross-section diagram in FIG. 5, the winding device is realized as a relatively robust roller 20, which is mounted on bearings and driven via its outside sprocket 21 and via a chain by a motor 22 located on the outside of the housing, as is shown schematically in FIG. 3. FIG. 4 shows only the motor mount 22' for the first motor.

Inside the roller 20 there sits, as shown in FIG. 5, a second drive motor 19 that is connected to the fan 3 and fixedly mounted in the opposite end wall of the housing 2. The roller 20, which is equipped with a securing device 23 for the pull lines, is also rotatably mounted in bearings around the second drive motor. As FIG. 4 best illustrates, the rotor of the centrifugal fan sits with its shaft somewhat off-center in relation to the inflation opening 31 (FIG. 5) that is realized in the side wall of the housing 2 facing the fan, and thus oriented about a circle whose center is displaced upwardly and toward the opening 4 in FIG. 4 relative to the axis of rotation of the fan rotor. It has been found that this off-centering is sufficient to fully counteract a tendency for the fan to be driven in reverse by the airflow and thus to generate increased air resistance. It thereby becomes possible to let the air from a balloon that is being pulled in be conducted backward through the non-rotating and undriven fan. As is known, a centrifugal fan will, when run backwards, push air in the same direction as it does in its normal direction of rotation, albeit with a lower airflow.

The drive motor for the roller 20 is equipped with a control system that senses when the balloon is being pulled in, whereupon the reinforced portion 6, which is last to be pulled in, will be able to actuate, e.g. a microswitch in the house. When the balloon is to be blown outward, the motor is allowed to be driven so that the roller rotates very slightly, whereupon a sufficient portion of the section 6 becomes slack enough for the positive pressure created via the fan 3 to suffice to thereafter unreverse and push out the entire balloon. It is then unnecessary to drive the roller at all; it is enough rather to let it spin free.

FIG. 5 also shows that an electric heating element 24 and a thermostat 25 are also mounted inside the roller 20. The device is thereby prevented from becoming frozen stuck when the moisture drawn in with the balloon freezes. This can obviously be foregone in warm climate.

It is normally desirable to mount the deployment and undeployment device in, e.g. a vehicle, under concealment behind some type of hatch. Among the alternatives that present themselves may be noted a first example, depicted in FIG. 4, in which the entire housing is secured adjacent to a hatch and pivotable about a shaft near one lateral edge of said hatch, while in a second example as per FIG. 6 the actual housing with its roller and fan is allowed to be fixedly secured, but with an openable hatch in front of its opening. The first example may be suitable for a horizontal or nearly horizontal surface, e.g. beneath a gun turret, which can then be covered or hidden by a camouflage balloon inflated from below. The second alternative may be suitable for installation in a vertical wall.

Figure 6:
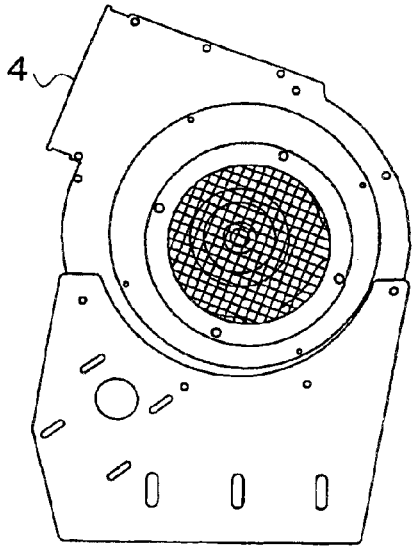
FIG. 6 depicts a variant, with respect to the way in which it is mounted, of the deployment and undeployment device.

A pivot shaft or hinge 40 is arranged in the variant shown in FIG. 4, around which the housing 2 can be pivoted by a motor 41 (schematically as in FIG. 3), and so that the opening 4 is exposed by opening a hatch 42 in the object to be camouflaged, and wherein the hatch 42 and the blowout device are joined. The embodiment shown in FIG. 6 is the same as the one in FIGS. 4 and 5 in terms of the deployment and undeployment of a camouflage balloon, but includes no hatch, which may instead by arranged separately. In this case the opening 4 is oriented obliquely upward from the start.

It will be obvious to one skilled in the art that a number of different variants are possible according to this invention, and that the description herein offers just one example, and that the invention is thus limited only by the claims that follow.

What is claimed is:

1. Rapidly deployable camouflage for the application of camouflaging and signature-concealing volumes to military objects such as vehicles, tanks, artillery guns, etc., characterized by, in combination, a) a pneumatically inflatable camouflage balloon (1) whose surface it at least partly camouflaged against reconnaissance in visible light, IR, UT and/or radar radiation, which camouflage balloon has an opening (5) for inflation with air and at least one pull line (7) that is secured at one end to the inside of the balloon opposite said opening, making it possible to pull the balloon, in its deflated state and while undergoing reversal, into a compartment through an opening to which said opening of the camouflage balloon is joined, and b) a deployment and undeployment device that comprises a housing (2), a motor-driven fan (3) for supplying air to the housing, a motor-driven roller (20) in the housing, which roller is equipped with a securing device (23) for the opposite end of said at least one pull line (7), an opening (4) in the housing facing in a direction transverse to the motor-driven roller, which opening is equipped with a securing device (10) for the sealed mounting and securing said opening (5) of the camouflage balloon.

2. Rapidly deployable camouflage according to claim 1, characterized in that the number of pull lines (7) is two, and in that they are secured to the inside of the balloon at a common spacing from one another.

3. Rapidly deployable camouflage according to claim 2, characterized in that the securing device (23) on the roller is arranged for the securing of pull lines at a common spacing from one another that is 1.5–3 times smaller and preferably 2 times smaller than the common spacing between their attachments to the inside of the balloon.

4. A camouflage balloon whose surface is at least partly camouflaged against reconnaissance in visible light, IR, UV and/or radar radiation, characterized by an inflation opening (5) and, opposite same on the inside of the balloon, one end of at least one pull line (7) whose length is sufficient to allow the balloon to extend outside of the inflation opening when the balloon is inflated.

5. A camouflage balloon according to claim 4, characterized in that it is made at least primarily of an air-permeable material such as thin polyamide fabric that is provided with camouflage coating.

6. A camouflage balloon according to claim 4 or 5, characterized in that it is provided in a section nearest the inflation opening (5) with a wear-resistant reinforcement (6).

7. A camouflage balloon according to claim 4, characterized in that it has two pull lines (7) secured at a common spacing to the inside of the balloon opposite the inflation opening (5).

8. A camouflage balloon according to claim 7, characterized in that flexible extended limiting devices (8) are secured with their opposite ends at opposing points on the inside of the balloon, preferably located outside of an area delimited by the pull lines (7) when they are extended from their attachment points to the respective outer portions of the inflation opening, whereupon the balloon is conferred with, in its inflated state, somewhat indented sections around the limiting devices.

* * * * *